US008188815B2

(12) United States Patent
Ko

(10) Patent No.: US 8,188,815 B2
(45) **Date of Patent: *May 29, 2012**

(54) WATERPROOF WAVEGUIDE ASSEMBLY HAVING A CORE PART WITH A SEAM FORMED BY ENGAGING PARTS AND THE CORE PART ENCLOSED BY A SEPARATE EXTERNAL HOUSING

(75) Inventor: Tung Yi Ko, Hsinchu (TW)

(73) Assignee: Microelectronics Technology, Inc., Hsinchu (TW)

( * ) Notice: Subject to any disclaimer, the term of this patent is extended or adjusted under 35 U.S.C. 154(b) by 182 days.

This patent is subject to a terminal disclaimer.

(21) Appl. No.: 12/556,059

(22) Filed: Sep. 9, 2009

(65) Prior Publication Data

US 2010/0109820 A1 May 6, 2010

(30) Foreign Application Priority Data

Nov. 4, 2008 (TW) ..... 97219686 U

(51) Int. Cl.
*H01P 3/12* (2006.01)

(52) U.S. Cl. ..... 333/248; 333/254

(58) Field of Classification Search ..... 333/239, 333/241, 242, 248, 254
See application file for complete search history.

(56) References Cited

U.S. PATENT DOCUMENTS 2,783,440 A * 2/1957 Lovick, Jr. ..... 333/239
3,648,201 A * 3/1972 Gissel ..... 333/241
3,692,063 A * 9/1972 Wagele ..... 138/139
5,398,010 A * 3/1995 Klebe ..... 333/239

* cited by examiner

*Primary Examiner* — Benny Lee
(74) *Attorney, Agent, or Firm* — WPAT, P.C.; Anthony King

(57) ABSTRACT

A waterproof communication apparatus comprises a core part and a separate external housing. The core part is a combination having at least one seam, and is used to transmit electromagnetic waves. The separate external housing covers the core part to prevent environmental moisture from entering the inside of the communication apparatus through the seam. A pair of engaging parts having complementary shapes is equipped with the seam of the combination so as to further prevent the molten material of the separate external housing from entering the inside of the communication apparatus during the manufacturing process. In another embodiment, the core part and separate external housing are made of metals and are combined by a metallurgic method.

26 Claims, 7 Drawing Sheets

WATERPROOF WAVEGUIDE ASSEMBLY HAVING A CORE PART WITH A SEAM FORMED BY ENGAGING PARTS AND THE CORE PART ENCLOSED BY A SEPARATE EXTERNAL HOUSING

BACKGROUND OF THE INVENTION (A) Field of the Invention

The present invention relates to a communication apparatus, and more particularly, to a covered waterproof structure of a communication apparatus.

(B) Description of the Related Art

Communication apparatuses placed outdoors must face exposure to various weather conditions. Rain seriously affects the communication apparatus. Therefore, the waterproof design of the outdoor communication apparatus is very important.

The common communication apparatus is composed of a plurality of parts. The seams between the parts having seams are mainly channels where moisture existing in the environment can penetrate into the communication apparatus. Therefore, the ability of the communication apparatus to withstand water exposure is closely related to the waterproofing treatment of these seams.

FIG. 1 shows a schematic diagram of a conventional waterproof structure. The communication apparatus 100*a* is composed of an upper assembly part 102 and a lower assembly part 104, and a seam 106 is between the upper assembly part 102 and the lower assembly part 104. An O-ring 108 placed in the seam 106 is deformed after the upper assembly part 102 and the lower assembly part 104 are attached by a screw 110 so as to achieve the objective of waterproofing. However, since the O-ring 108 is solid, the tiny cavities in the rough surfaces sandwiching the O-ring 108 are not sufficiently filled. Therefore, the combination cannot completely prevent the moisture from penetrating into the inside. Furthermore, the O-ring 108 will deteriorate from long-term use, and such deterioration affects waterproofing ability.

FIG. 2 is a schematic diagram of a conventional waterproof structure. In the prior art, the seam 106 between the upper assembly part 102 and the lower assembly part 104 is sealed by adhesive 202 so as to achieve the objective of waterproofing. Although the adhesive 202 fills in the tiny cavities of the rough surfaces enclosing the seam 106, it cannot resist weather over a long period of time and easily deteriorates under exposure to ultraviolet rays. Therefore, such design also cannot have a completely waterproof effect.

In view of above, the market has not provided a completely waterproof and weather-resistant design for an outdoor communication apparatus to date because long-term exposure to ultraviolet radiation causes deterioration of sealing materials. That is, choosing an adequate material for a waterproof design is quite difficult, and there is an urgent need for a completely waterproof design for an outdoor communication apparatus capable of resisting adverse weather conditions.

SUMMARY OF THE INVENTION

An aspect of the present invention is to provide a completely waterproof outdoor communication apparatus. The part of the communication apparatus for transmitting electromagnetic waves is enclosed by a cover to prevent external moisture from entering the inside of the communication apparatus so as to achieve the completely waterproof objective.

Another aspect of the present invention is to provide a completely waterproof communication apparatus that can prevent external moisture from entering its interior even before the cover is completely formed. The seam between cover portions includes a pair of engaging parts having complementary shapes to prevent the molten material of the cover from entering the inside of the communication apparatus during the manufacturing process.

The present invention discloses a waterproof communication apparatus comprising a core part and a separate external housing. The core part is a combination having at least one seam, and is used to transmit electromagnetic waves. The separate external housing covers the core part to prevent environmental moisture from entering the inside of the communication apparatus through the seam. A pair of engaging parts having complementary shapes is disposed between the seam of the combination so as to further prevent the molten material of the separate external housing from entering the inside of the communication apparatus during the manufacturing process.

The present invention further discloses a waterproof communication apparatus comprising a core part and an aforesaid separate external housing. The core part is a combination having at least one seam, and having a wave guide structure on its inside surface. A pair of engaging parts having complementary shapes is disposed between the seam of the combination so as to further prevent the molten material of the separate external housing from entering the inside of the communication apparatus during the manufacturing process.

In another embodiment, a waterproof communication apparatus comprises a core part and a separate external housing. The core part is a combination having at least one seam. The separate external housing is formed by molding to cover the core part and prevent environmental moisture from entering the inside of the communication apparatus through the seam. A pair of engaging parts having complementary shapes is disposed between the seam of the combination so as to further prevent the molten material of the separate external housing from entering the inside of the communication apparatus during the manufacturing process.

BRIEF DESCRIPTION OF THE DRAWINGS

The objectives and advantages of the present invention will become apparent upon reading the following description and upon reference to the accompanying drawings in which.

DETAILED DESCRIPTION OF THE INVENTION

The following descriptions illustrate a waterproof communication apparatus of the present invention using the accompanying drawings. Regarding the schematic diagrams disclosed by embodiments, the present invention is merely illustrated by diagrams, but the scope of the present invention is not limited by the diagrams. These schematic diagrams show the structure of the apparatus, and the dimensions of the diagrams cannot limit the scope of the present invention. The foregoing statements are provided for further understanding before the following embodiments are introduced.

Figure 1:
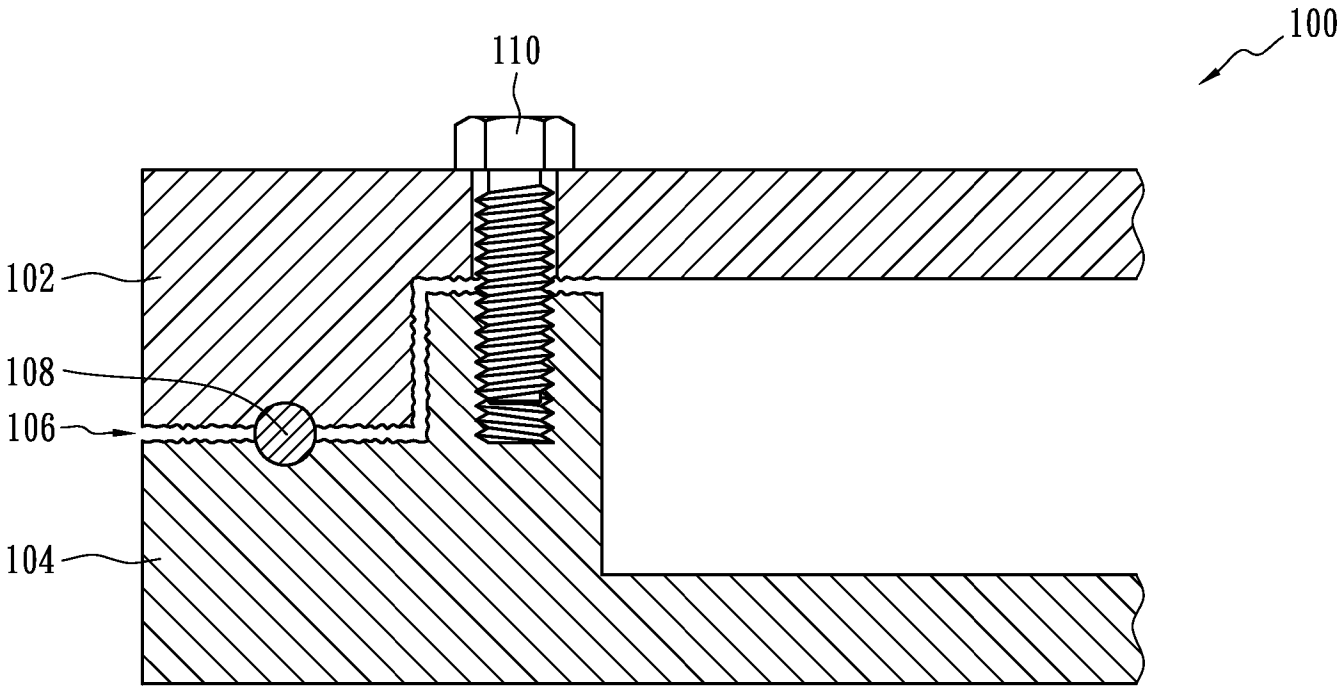
FIG. 1 (Prior Art)
FIG. 1 shows a schematic diagram of a conventional waterproof structure.
Figure 2:
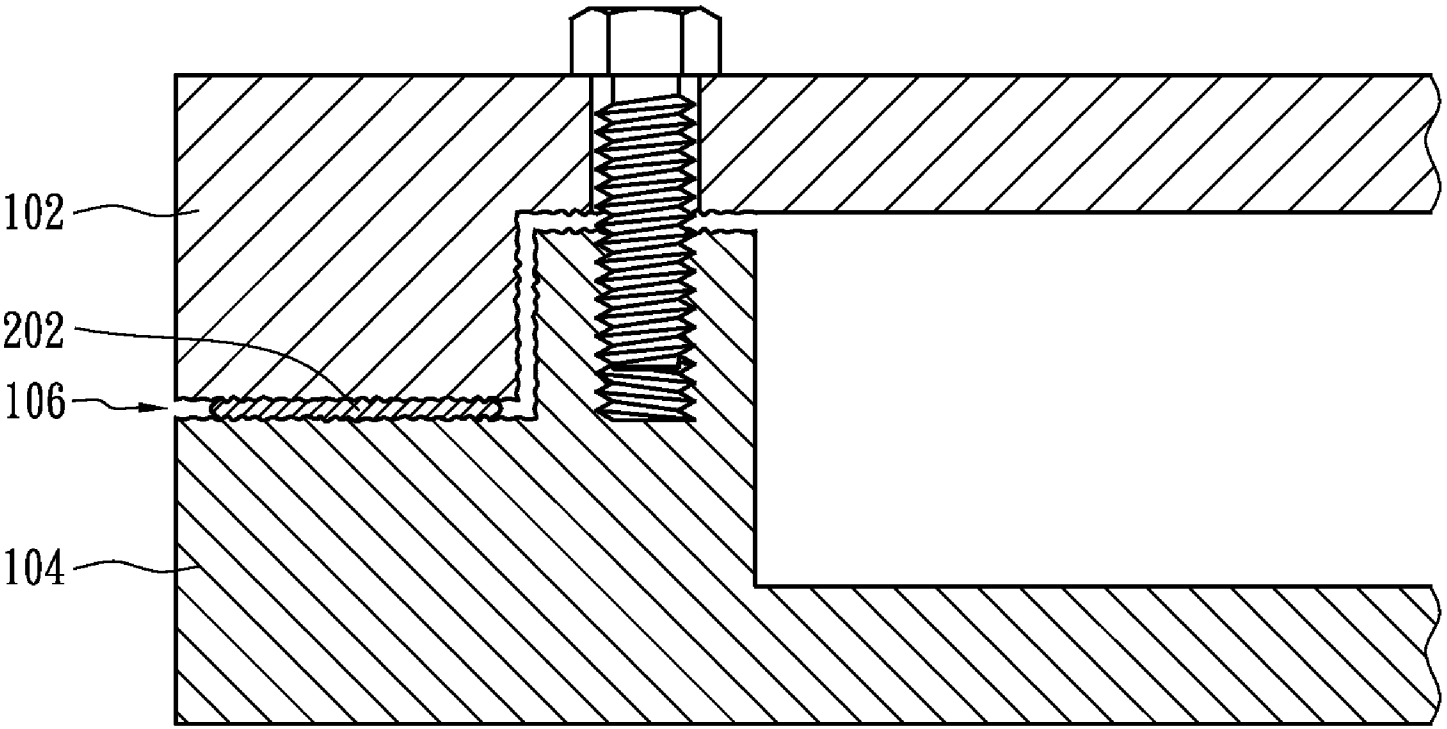
FIG. 2 (Prior Art)
FIG. 2 is a schematic diagram of a conventional waterproof structure.
Figure 3:
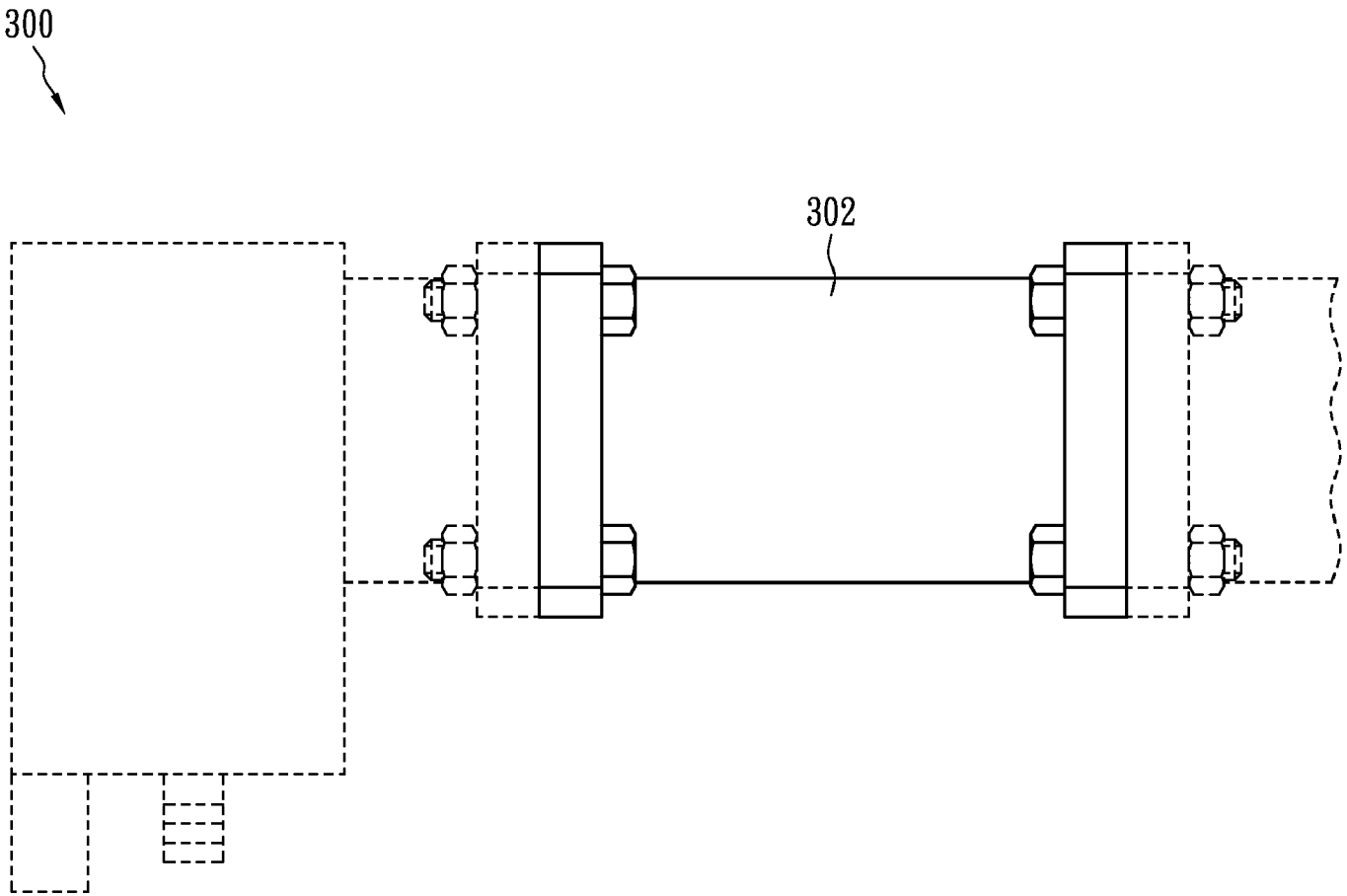
FIG. 3 is a schematic diagram of a communication apparatus in accordance with an embodiment of the present invention.

FIG. 3 is a schematic diagram of a communication apparatus in accordance with an embodiment of the present invention. Referring to FIG. 3, a communication apparatus 300 comprises a communication device 302 for transmitting electromagnetic waves. The communication device 302 is a waveguide including a waveguide structure (not shown) inside.

Figure 4:
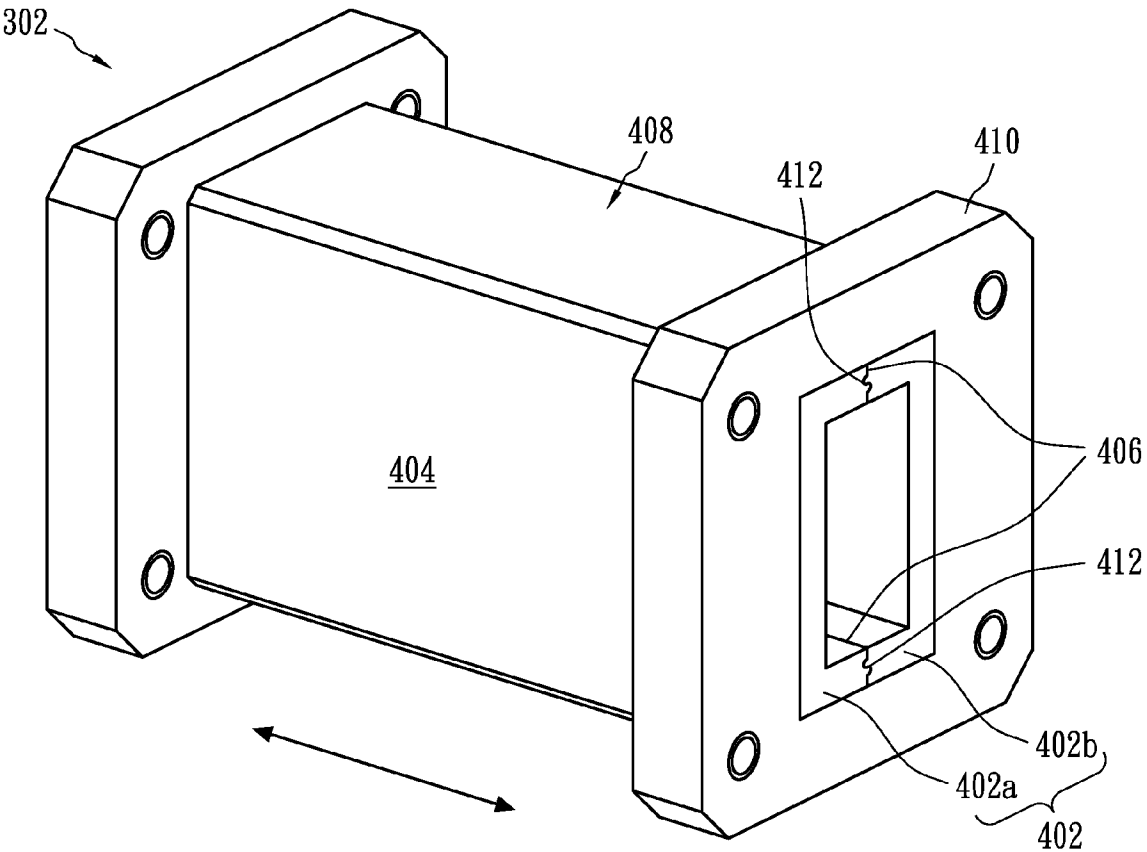
FIG. 4 is a schematic diagram of a communication apparatus in accordance with another embodiment of the present invention.

FIG. 4 is a schematic diagram of a waterproof communication apparatus 302 in accordance with another embodiment of the present invention. The waterproof communication apparatus 302 comprises a core part 402 and a separate external housing 404 covering the core part 402 therein. The lengths of the separate external housing 404 and the core part 402 are substantially equal along the lengthwise direction (as shown by the arrow in FIG. 4). The separate external housing 404 tightly encapsulates the core part 402. Both the core part 402 and the separate external housing 404 can be metal. The core part 402 and the separate external housing 404 are combined by a metallurgic method. The separate external housing 404 can also be made of non-metal material or plastic material, and covers the core part 402 by an injection molding method. In one embodiment, the core part 402 is put in a casting mold, and the core part 402 is covered by the casting member of the separate external housing 404 by molding.

Referring to FIG. 4, the core part 402 is a combination comprising a first member 402*a* and a second member 402*b*. There is a seam 406 between the first member 402*a* and the second member 402*b* after the core part 402 is assembled. The seam 406 is completely covered by the separate external housing 404, and the external surface 408 of the separate external housing 404 is seamless. The separate external housing 404 covers the core part 402 to prevent environmental moisture from entering the inside of the communication device 302 through the seam 406 so as to achieve the objective of complete waterproofing.

However, during the casting or injection of the aforesaid separate external housing 404, the molten metal or un-solidified plastic can flow into the seams 406 because of pressure. If the molten metal or un-solidified plastic penetrates into the inner wave guide channel of the core part 402 through the seams 406, the transmission of the electromagnetic wave is negatively affected. A pair of engaging parts 412 having complementary shapes is disposed between the seam 406 of the combination so as to further prevent the molten material of the separate external housing from entering the inside of the communication device 302 during the manufacturing process. In this embodiment, the engaging parts 412 are respectively disposed between the seam 406 between the first member 402*a* and the second member 402*b*, and the engaging parts 412 are a pair of wave-shaped uneven portions having shapes complementary to each other. The engaging parts 412 of the present invention are not limited by the wave-shaped uneven portions, and other concave and convex portions having shapes complementary to each other are also within the scope of the present invention.

Referring to FIG. 4, the separate external housing 404 has a flange 410. The communication device 302 can be combined with the other parts of the waterproof communication apparatus 300 through the flange 410.

Figure 5:
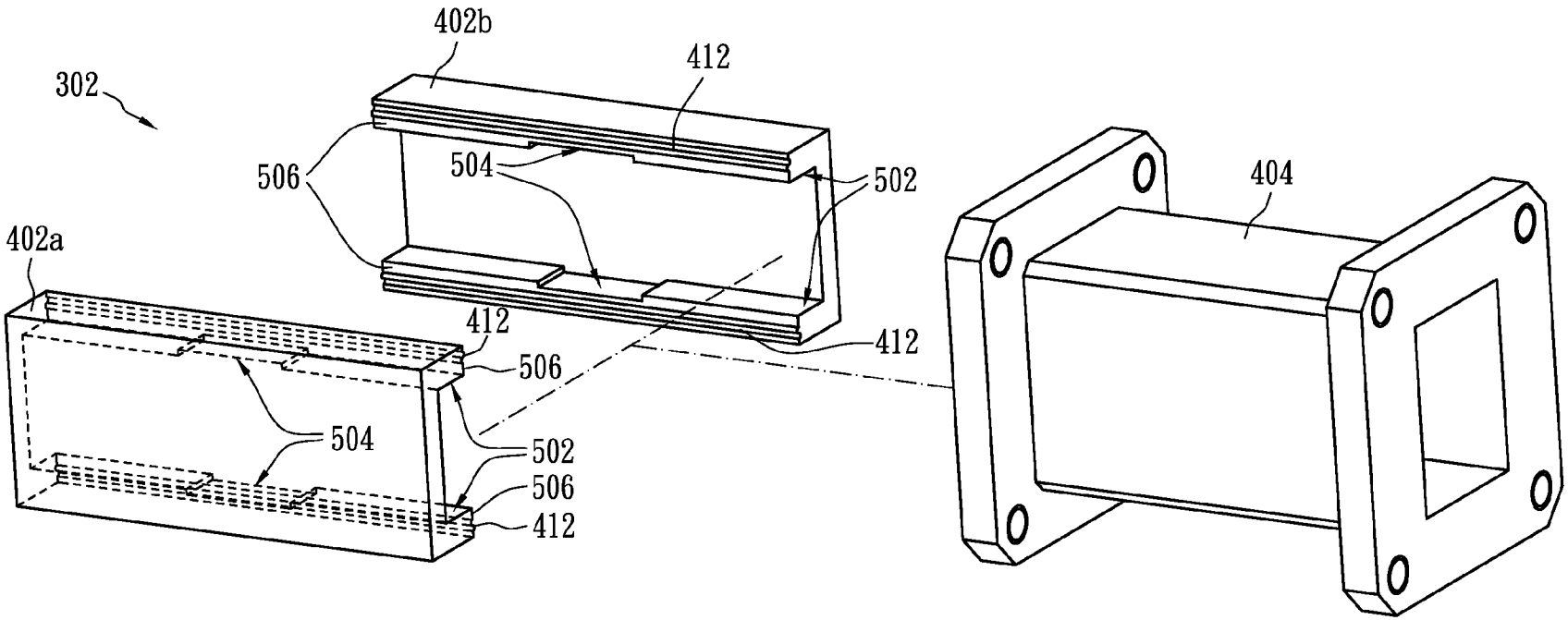
FIG. 5 is an exploded diagram of a communication apparatus in accordance with an embodiment of the present invention.

FIG. 5 is an exploded diagram of a waterproof communication apparatus 302 in accordance with an embodiment of the present invention. Referring to FIGS. 4 and 5, the inner surfaces 502 (FIG. 5) of the first member 402*a* and the second member 402*b* have stepped portions 504 (FIG. 5). In this embodiment, the stepped portion 504 is concave. Because the inside of the waterproof communication apparatus 302 comprises the stepped portions 504, it is not easy to release the molded waterproof communication apparatus 302 from the mold. Therefore, the waterproof communication apparatus needs to be divided into several parts for easily implementing the manufacturing processes. After the parts are finished, they are assembled together. However, the waterproof communication apparatus 302, being the combination of several parts, has seams on its outside, and moisture easily penetrates into its interior. To address this issue, the present invention encapsulates the first member 402*a* and the second member 402*b* into the separate external housing 404 without any seams so as to achieve a completely sealed device. The pair of engaging parts 412 having complementary shapes is included with the connecting surfaces 506 (FIG. 5) of the first member 402*a* and the second member 402*b*. The two corresponding connecting surfaces 506 (FIG. 5) connect to each other to form the seam 406 (FIG. 4) therebetween. The engaging parts 412 engage each other. Although the core part 402 (FIG. 4) is divided into several parts for the requirement of the manufacturing processes and there is a seam 406 between the parts assembled, the seam 406 is encapsulated into the separate external housing 404 of the waterproof communication apparatus 302 so as to prevent the penetration of moisture.

Figure 6:
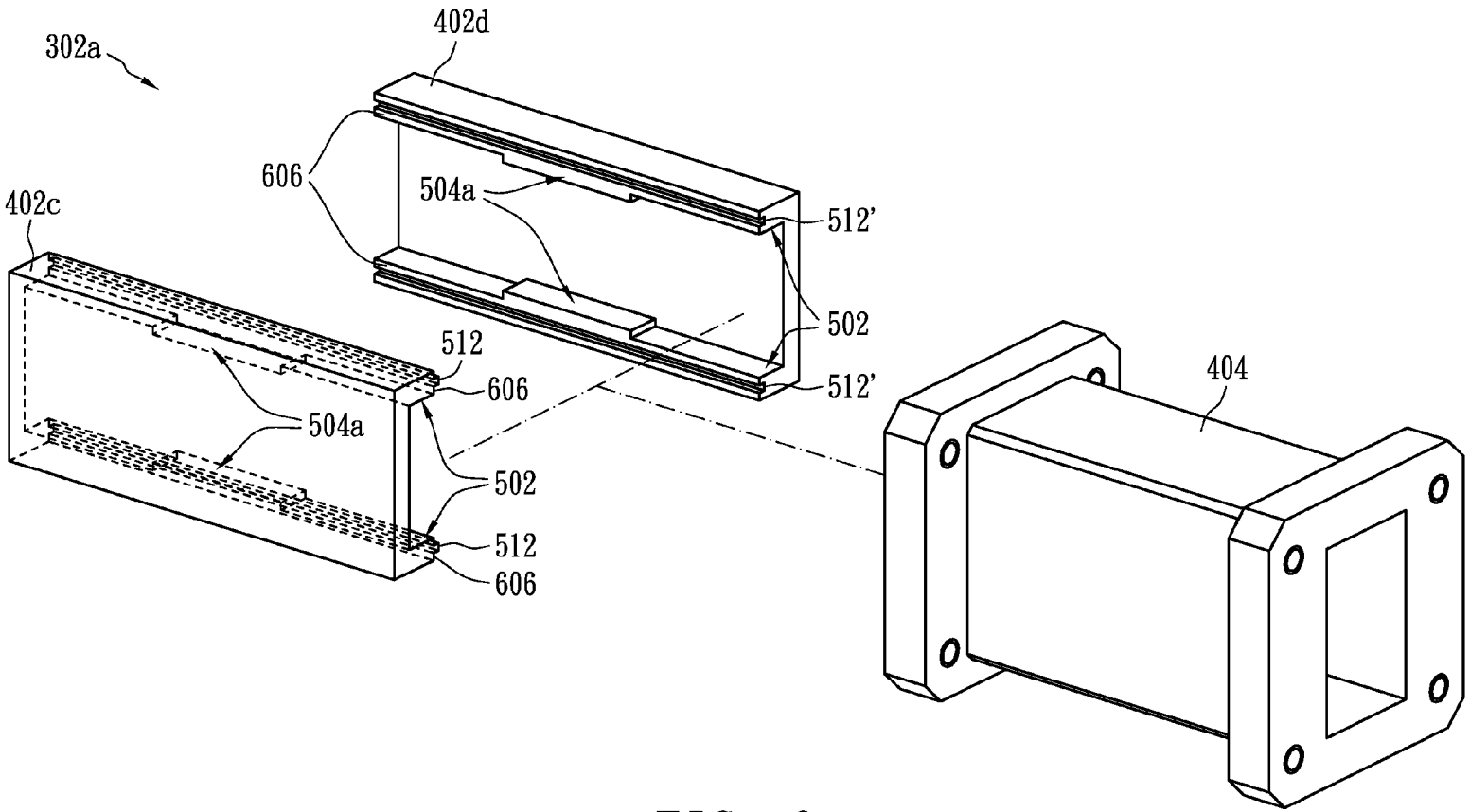
FIG. 6 is an exploded diagram of a communication apparatus in accordance with another embodiment of the present invention.

FIG. 6 is an exploded diagram of a waterproof communication apparatus 302*a* in accordance with another embodiment of the present invention. In this embodiment, the inner surfaces 502 of the first member 402*c* and the second member 402*d* have respective stepped portions 504*a*. The stepped portion 504*a* is convex. Similarly, a pair of engaging parts 512 and 512' having complementary shapes are included with the connecting surfaces 606 of the first member 402*c* and the second member 402*d*. The engaging parts 512 and 512' are respectively a rectangular convex portion and a rectangular concave portion so they can engage with each other. The separate external housing 404 can also be made of non-metal material or plastic material, and covers the waterproof communication apparatus 302*a* by an injection molding method.

In an embodiment, the stepped portions (504 and 504*a*) can be a wave guide structure. Therefore, the core part 402 is a wave guide device.

Figure 7A:
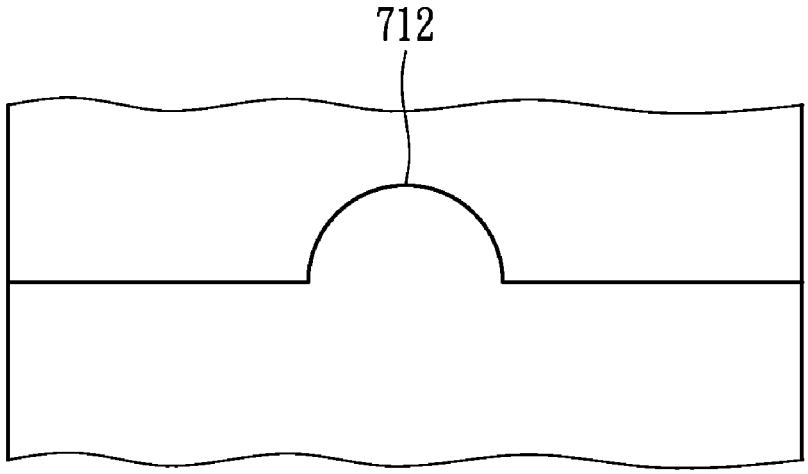
FIGS. 7A and 7B are schematic diagrams of engaging parts in accordance with another embodiment of the present invention.
Figure 7B:
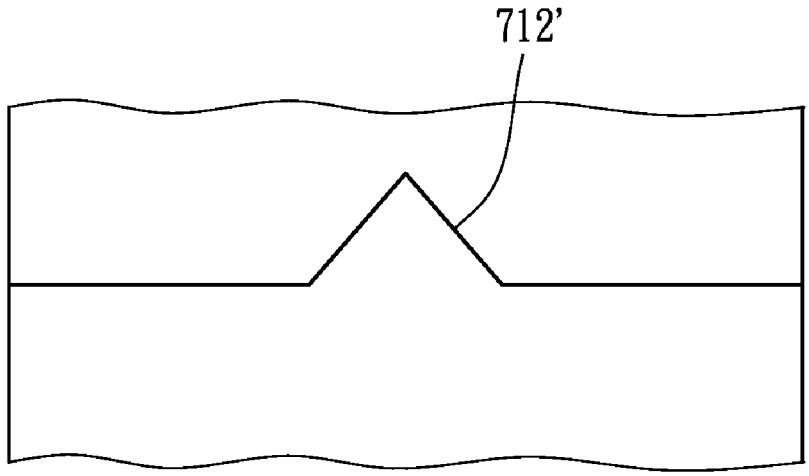

FIGS. 7A and 7B are schematic diagrams of engaging parts in accordance with another embodiment of the present invention. Referring to FIG. 7A, the engaging parts 712 are respectively a semicircular convex portion and a semicircular concave portion. Referring to FIG. 7B, the engaging parts 712' are respectively a triangular convex portion and a triangular concave portion. The engaging parts of the present invention are not limited by these convex and concave portions, and other convex and concave portions respectively with any complementary profiles are included in the scope of the following claims.

The above-described embodiments of the present invention are intended to be illustrative only. Those skilled in the art may devise numerous alternative embodiments without departing from the scope of the following claims.

What is claimed is:

1. A waterproof communication apparatus comprising:

a core part, configured for transmitting electromagnetic waves and including a first member, and a second member, wherein the first member is separably connected with the second member, the first member and the second member include a pair of engaging parts, and a seam is formed between the pair of engaging parts; and a separate external housing, having a seamless outer surface, wherein the core part is located within the separate external housing to prevent environmental moisture from entering the inside of the core part through the seam, wherein there is no space between the core part and the separate external housing, the core part itself does not include a flange and the core part and the separate external housing are two separate physical structures.

2. The waterproof communication apparatus of claim 1, wherein the pair of engaging parts are a semicircular convex portion and a semicircular concave portion.

3. The waterproof communication apparatus of claim 1, wherein the separate external housing is made of a non-metal material.

4. The waterproof communication apparatus of claim 1, wherein the core part and the separate external housing are made of metal and are combined by a metallurgic method.

5. The waterproof communication apparatus of claim 1, wherein the pair of engaging parts have complementary shapes.

6. The waterproof communication apparatus of claim 1, wherein the pair of engaging parts are wave-shaped uneven portions.

7. The waterproof communication apparatus of claim 1, wherein the pair of engaging parts are a rectangular concave portion and a rectangular convex portion.

8. The waterproof communication apparatus of claim 1, wherein the pair of engaging parts are a triangular convex portion and a triangular concave portion.

9. A waterproof communication apparatus comprising:

a core part, including a first member, a second member, and a stepped portion, the first member is separably connected with the second member, the first member and the second member include a pair of engaging parts, a seam is formed between the pair of engaging parts, and the stepped portion is formed in an inner surface of the core part where the first member connects with the second member and the stepped portion is a concave structure or a convex structure; and a separate external housing, wherein the core part is located within the separate external housing to prevent environmental moisture from entering the inside of the core part through the seam, wherein there is no space between the core part and separate external housing, the core part itself does not include a flange and the core part and the separate external housing are two separate physical structures.

10. The waterproof communication apparatus of claim 9, wherein the pair of engaging parts are a semicircular convex portion and a semicircular concave portion.

11. The waterproof communication apparatus of claim 9, wherein the separate external housing has a seamless outer surface.

12. The waterproof communication apparatus of claim 9, wherein the separate external housing is made of a non-metal material.

13. The waterproof communication apparatus of claim 9, wherein the core part and the separate external housing are made of metal and are combined by a metallurgic method.

14. The waterproof communication apparatus of claim 9, wherein the separate external housing further includes a flange.

15. The waterproof communication apparatus of claim 9, wherein the pair of engaging parts have complementary shapes.

16. The waterproof communication apparatus of claim 9, wherein the pair of engaging parts are wave-shaped uneven portions.

17. The waterproof communication apparatus of claim 9, wherein the pair of engaging parts are a rectangular concave portion and a rectangular convex portion.

18. The waterproof communication apparatus of claim 9, wherein the pair of engaging parts are a triangular convex portion and a triangular concave portion.

19. A waterproof communication apparatus comprising:

a wave guide device, configured for transmitting electromagnetic waves and including a first member, a second member and a stepped portion, wherein the first member is separably connected with the second member, the first member and the second member include a pair of engaging parts, and a seam is formed between the pair of engaging parts, and wherein the stepped portion is formed in an inner surface of the wave guide device where the first member connects with the second member, and the stepped portion is formed as a concave structure or a convex structure; and a separate external housing, wherein the wave guide device is located within the separate external housing to prevent environmental moisture from entering the inside of the wave guide device through the seam, wherein there is no space between the wave guide device and the separate external housing, wherein the wave guide device itself does not include a flange and the wave guide device and the separate external housing are two separate physical structures.

20. The waterproof communication apparatus of claim 19, wherein the pair of engaging parts are a semicircular convex portion and a semicircular concave portion.

21. The waterproof communication apparatus of claim 19, wherein the separate external housing has a seamless outer surface.

22. The waterproof communication apparatus of claim 19, wherein the separate external housing further includes a flange.

23. The waterproof communication apparatus of claim 19, wherein the pair of engaging parts have complementary shapes.

24. The waterproof communication apparatus of claim 19, wherein the pair of engaging parts are wave-shaped uneven portions.

25. The waterproof communication apparatus of claim 19, wherein the pair of engaging parts are a rectangular concave portion and a rectangular convex portion.

26. The waterproof communication apparatus of claim 19, wherein the pair of engaging parts are a triangular convex portion and a triangular concave portion.

* * * * *